US005713692A

United States Patent [19]

McCarrick et al.

[11] Patent Number: 5,713,692

[45] Date of Patent: Feb. 3, 1998

[54] INVENTORY CONTROL COLLAR LOCKING RING

[75] Inventors: Henry Jemison McCarrick, Fallbrook; Kevin Cochrane Ross, San Clemente, both of Calif.

[73] Assignee: Span Instruments, Plano, Tex.

[21] Appl. No.: 683,715

[22] Filed: Jul. 17, 1996

[51] Int. Cl.[6] ..... F16B 39/282

[52] U.S. Cl. ..... 403/329; 411/526; 411/908

[58] Field of Search ..... 411/525, 526, 411/527, 437, 433, 908; 285/319; 403/329, 343

[56] References Cited

U.S. PATENT DOCUMENTS

| | | | |
|---|---|---|---|
| 3,102,508 | 9/1963 | Smith, Jr. | 411/437 X |
| 4,653,781 | 3/1987 | Sheets et al. | 285/319 |
| 4,944,536 | 7/1990 | Bartholomew | 285/319 |
| 5,195,860 | 3/1993 | Steyn | 411/526 |

FOREIGN PATENT DOCUMENTS

| | | | |
|---|---|---|---|
| 2238083 | 2/1975 | France | 411/527 |

*Primary Examiner*—Anthony Knight
*Attorney, Agent, or Firm*—Harold E. Meier

[57] ABSTRACT

A polymeric inventory control collar locking ring for securing an inventory control collar around the cylindrical neck of a storage container comprising a circular disc with a central opening sized to fit around the neck of the storage container and a plurality of inwardly disposed flexible tabs spaced equally around the perimeter of the central opening. The tabs are formed integrally with the disc and extend radially inward into the central opening, having a distance of projection sufficient to engage the neck of said storage container.

6 Claims, 4 Drawing Sheets

INVENTORY CONTROL COLLAR LOCKING RING

TECHNICAL FIELD

This invention relates to inventory control devices for containers and, more particularly, to a locking ring for an inventory control collar.

RELATED APPLICATIONS

The present application is a component of an inventory control system including co-pending U.S. application Ser. No. 08/683,774, filed concurrently herewith, titled INVENTORY CONTROL COLLAR, currently pending (Attorney Docket No. 78618-240); and co-pending U.S. application Ser. No. 08/683,702, filed concurrently herewith, titled INVENTORY CONTROL PROBE AND DOCKING STATION, currently pending (Attorney Docket No. 78618-242).

BACKGROUND OF THE INVENTION

Inventory control systems manage information about each item in a timely and cost effective manner. Typical types of critical inventory information that are often maintained include manufacturing, certification, initial shipping, transfer and use data. Down time and waste in manufacturing processes may be avoided with adequate, timely inventory information.

SUMMARY OF THE INVENTION

The inventory control collar locking ring of the present invention comprises a ring with a plurality of inwardly disposed tabs for securing an inventory control collar on the neck of a container such as a gas storage cylinder. The inventory control collar locking ring is positioned around the threaded neck of the storage container and on top of a previously installed inventory control collar, thereby securing the inventory control collar on the storage container. The present application is a component of an inventory control system described in the co-pending U.S. patent applications recited in the related application section, the disclosure of each is incorporated herein by reference.

The locking ring comprises a circular disc with a central opening sized to fit the outer diameter of the threaded neck of the storage container and a plurality of inwardly disposed flexible tabs spaced equally around the perimeter of the central opening. The tabs are formed integrally with the disc and extend radially inward into the central opening, having a distance of projection sufficient to engage the threaded neck of said storage container. Each tab has an upper surface angularly disposed upward from the plane of the disc and an under surface angularly disposed at a greater angle from the plane of the disc than the upper surface. When in use, the tabs form an interference fit with the threaded neck. The angular disposition of the tab surfaces provide added resistance to removal of the locking ring when it is engaged with the storage cylinder threaded neck.

In the preferred embodiment, ten tabs are equally spaced around the perimeter of the central opening and the angular displacement of the under surface from the plane of the disc is approximately 25 degrees.

BRIEF DESCRIPTION OF THE DRAWINGS

A more complete understanding of the present invention may be had by reference to the following Detailed Description when taken conjunction with the accompanying drawings wherein.

DETAILED DESCRIPTION OF THE INVENTION

Figure 1:
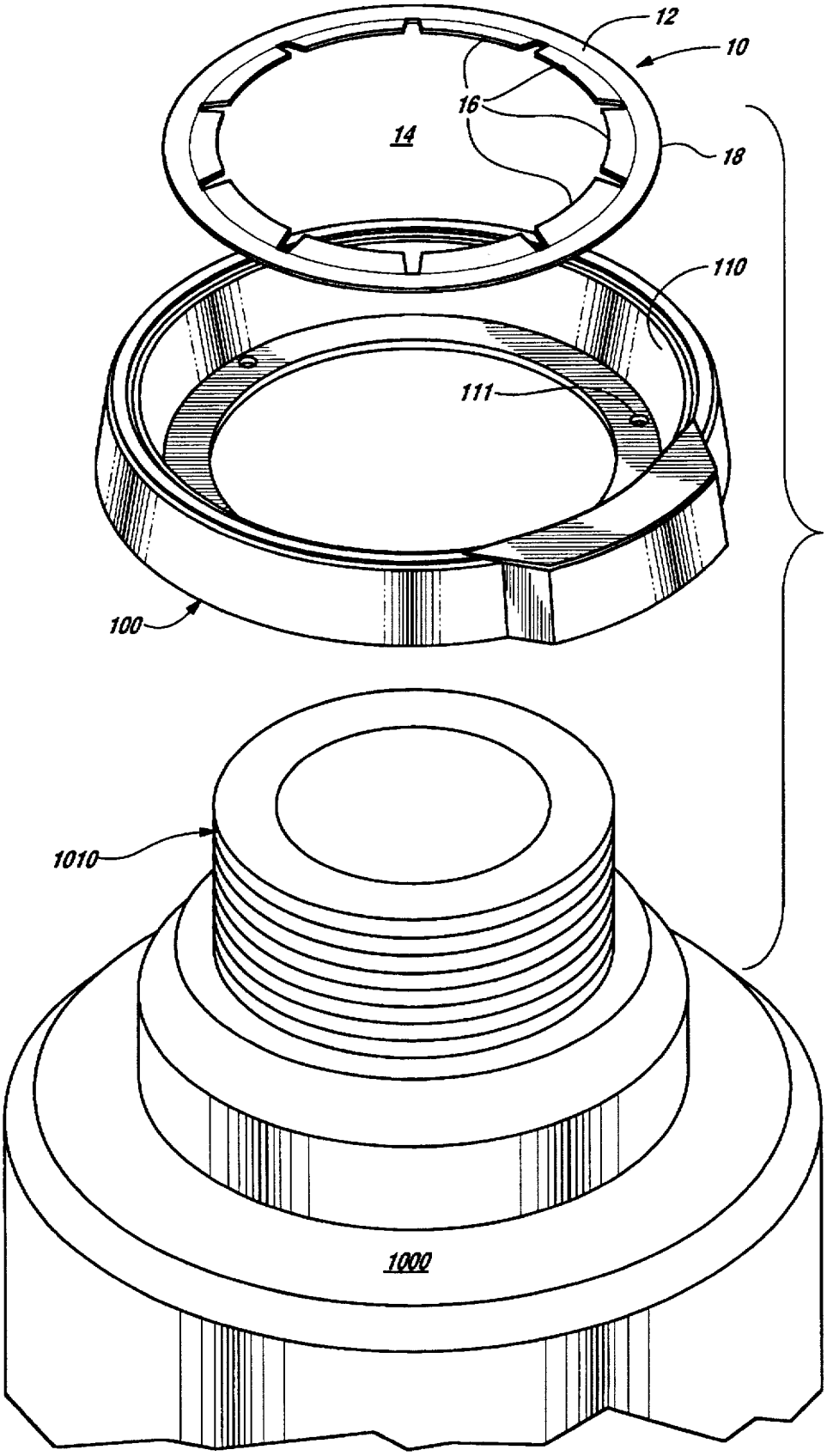
FIG. 1 is an exploded perspective view illustrating an inventory control collar and inventory control collar locking ring of the present invention.
Figure 2:
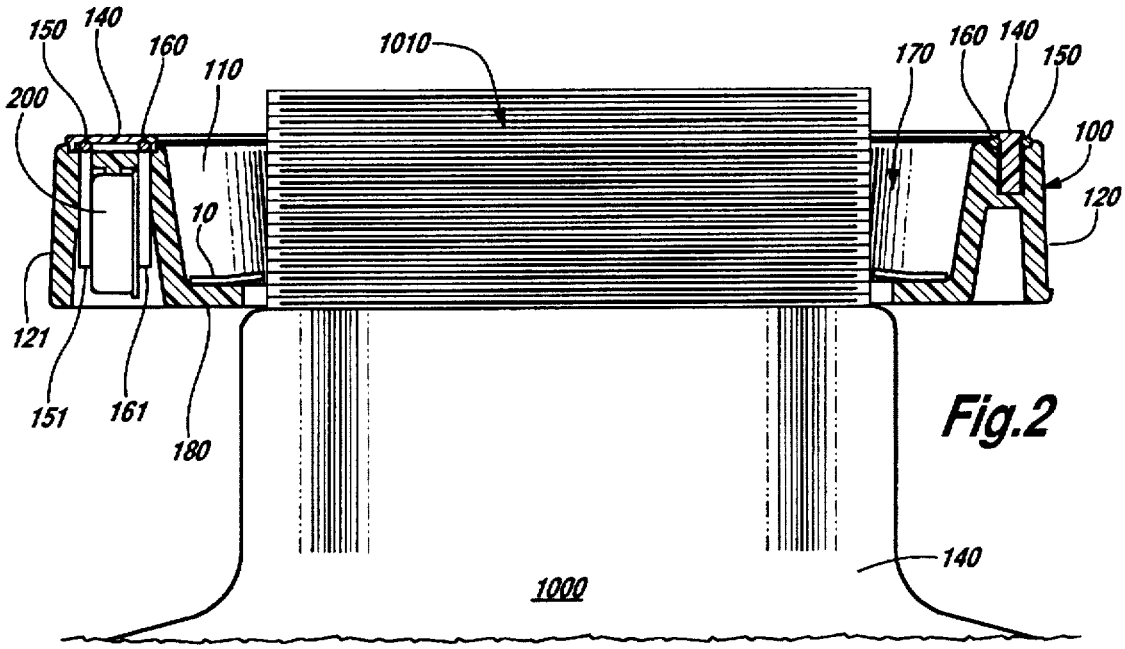
FIG. 2 is a cross section view illustrating the inventory control collar and the inventory control collar locking ring positioned around the threaded neck of a storage container.

Reference is now made to the Drawings wherein like reference characters denote like or similar parts throughout the 10 figures. Referring to FIG. 1, therein illustrated an inventory control collar locking ring 10 for securing an inventory control collar 100 around the threaded neck 1010 of a storage container 1000. Referring to FIG. 2, when in use, the inventory control collar locking ring 10 is positioned around the threaded neck 1010 of the storage container 1000 and engaging the previously installed inventory control collar 100. The locking ring 10 is sized to be received in a depression 110 in the inventory control collar 100 thereby securing the inventory control collar 100 on the storage container 1000.

Figure 9:
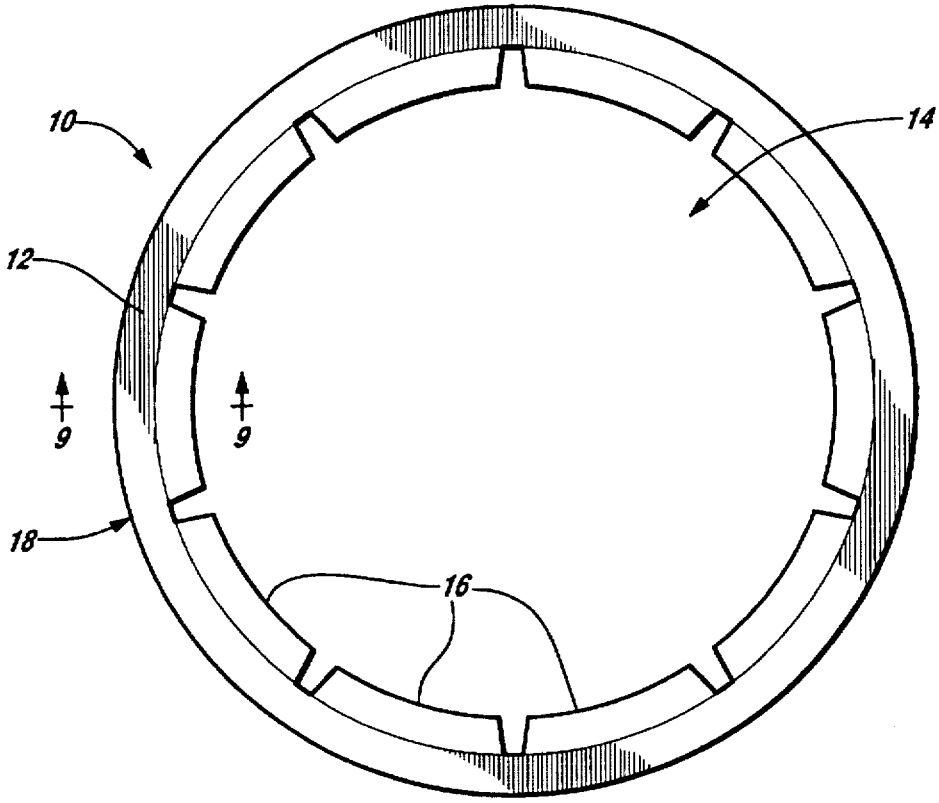
FIG. 9 is a top view of the inventory control locking ring.
Figure 10:
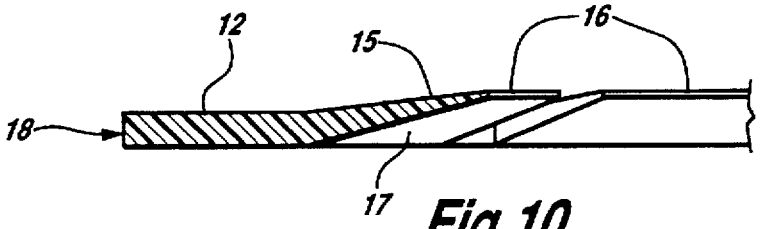
FIG. 10 is an enlarged cross section view of the inventory control ring taken along the line 9—9 of FIG. 9.

Referring now to FIGS. 1, 9 and 10, the locking ring 10 comprises a circular disc 12 with a central opening 14 sized to fit around the threaded neck 1010 of the storage container 1000 and a plurality of inwardly disposed flexible tabs 16 spaced equally around the perimeter of the central opening 14. The tabs 16 are formed integrally with the disc 12 and extend radially inward into the central opening 14, having a distance of projection sufficient to engage the threaded neck 1010 of the storage container 1000. In the preferred embodiment, the ten tabs 16 are equally spaced around the perimeter of the central opening 14. The outer perimeter 18 of the locking ring 10 is substantially the same as an inner perimeter 111 of the depression 110 of the inventory control collar 100.

As can be seen in FIG. 10, the tab 16 has an upper surface 15 angularly disposed upward from the plane of the disc 12 and an under surface 17 angularly disposed at a greater angle from the plane of the disc 12 than the upper surface 15. In the preferred embodiment, the angular displacement of the under surface 17 from the horizontal plane of the disc 12 is approximately 25 degrees. The angular disposition of the tab surfaces provide added holding power to the locking ring 10. When in an assembled state, these tabs form an interference fit with the threaded neck 1010.

Figure 3:
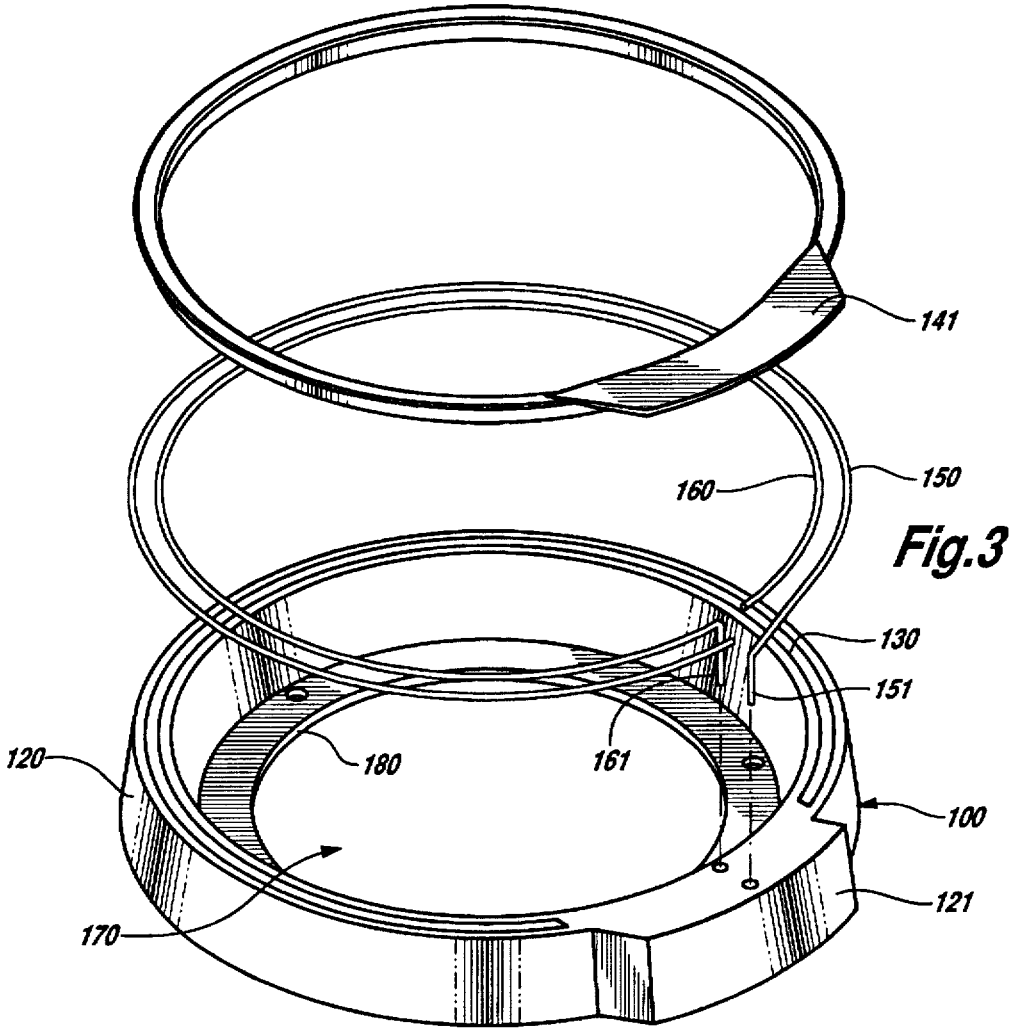
FIG. 3 is an exploded perspective view of components of the inventory control collar.
Figure 5:
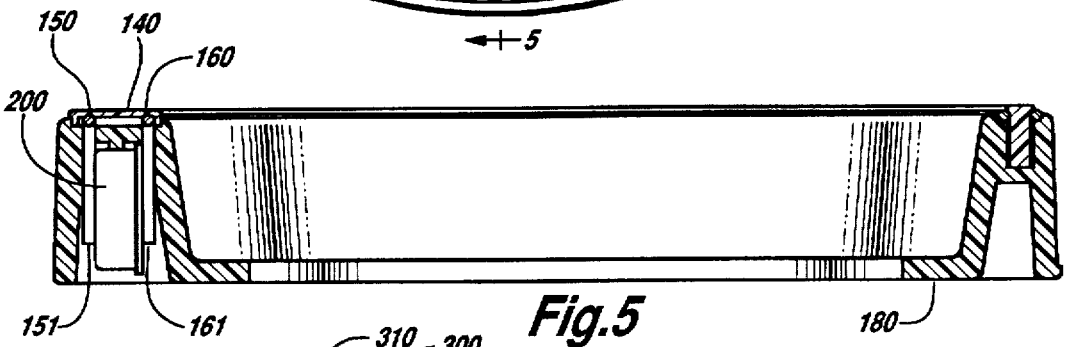
FIG. 5 is a cross section view of the inventory control collar taken along the line 5—5 of FIG. 4.

Referring to FIGS. 2 and 3, therein is shown an exploded view (FIG. 3) of the inventory control collar 100. The inventory control collar 100 includes a polymeric collar housing 120 having a truncated conal exterior shape with a nose 121 projecting from the exterior circumference. The nose 121 contains a touch memory cannister 200 (as seen in FIGS. 2 and 5). An outer first conductive ring 150 and an inner second conductive ring 160 are seated in "T" shaped groove 130 in the top of the collar housing 120. A "T" shaped insulating retainer ring 140 is inserted from the top between the first conductive ring 150 and the second ring 160. The conductive ring 150 begins at the nose 121 and extends circumferentially around the top of the collar housing 120 and terminates in a down-turned portion 151 at the nose 121. Likewise, the second ring 160 begins at the nose 121 and extends circumferentially around the top of the collar housing 120 and terminates in a down-turned portion 161 at the nose 121. The "T" shaped retainer ring 140 is a one-piece unit that begins at the nose 121 and extends circumferentially around the collar housing 120 and terminates at a nose cover 141 which is bonded to the retainer ring 140.

Figure 4:
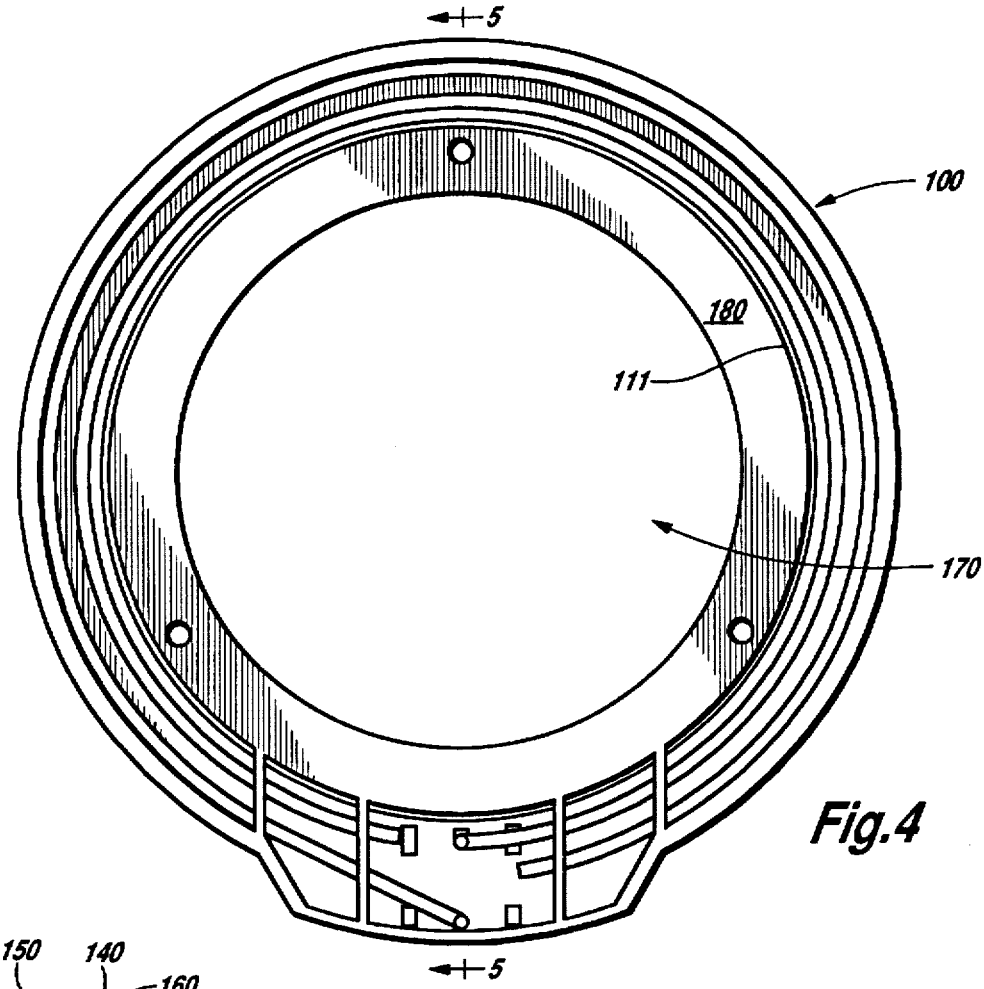
FIG. 4 is a top view of the inventory control collar without the insulating retainer ring and nose cover in position.

Referring to FIGS. 2, 4 and 5, the down-turned portions 161 and 151 penetrate the top of the nose 121 to connect with the data and ground contact points of the touch memory cannister 200 (not shown).

As can be seen in FIG. 2, the housing 120 includes a central opening 170 of sufficient diameter to pass the threaded neck 1010 therethrough.

Referring now to FIGS. 1–5, the housing 120 includes a bottom ledge 180 projecting inwardly into the opening 170. The inventory control collar locking ring 10 seats in the depression 110 and rests on the bottom ledge 180.

Figure 6:
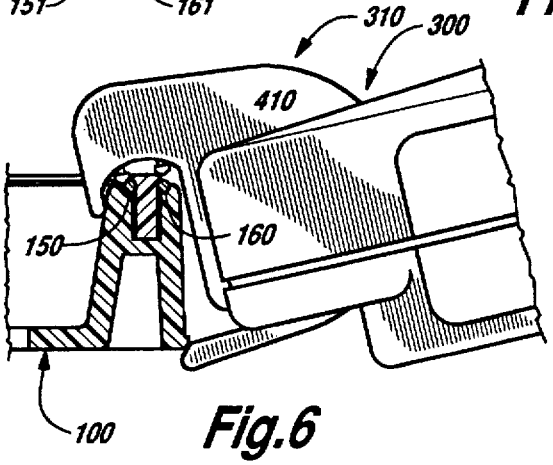
FIGS. 6 and 7 are partial views of a portion of an inventory control probe engaging the inventory control collar of the present invention.
Figure 7:
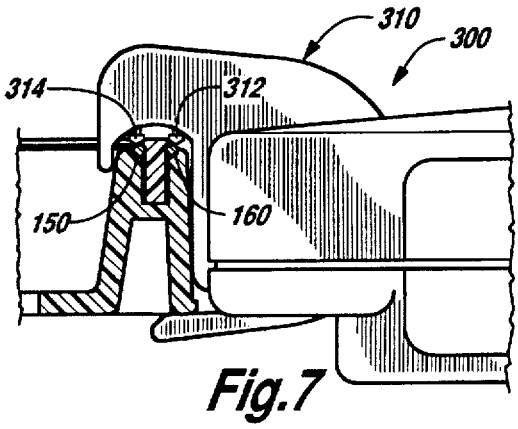
Figure 8:
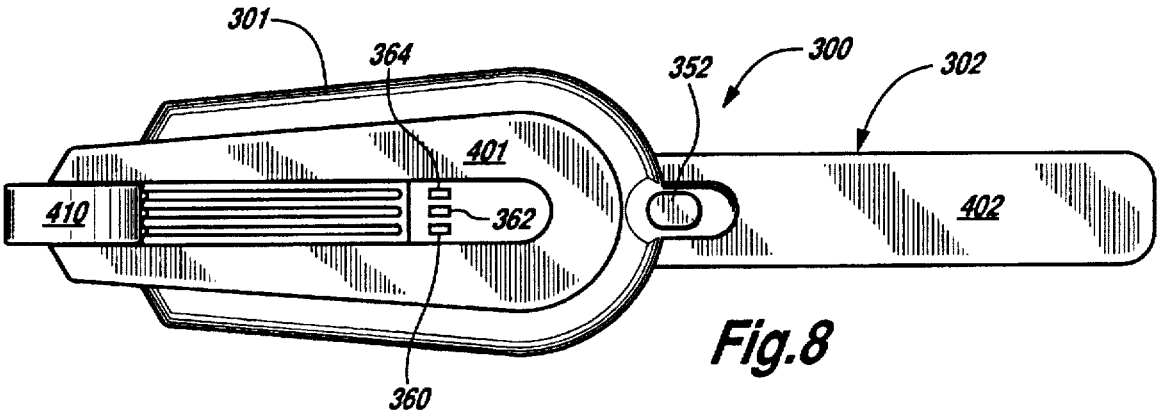
FIG. 8 is a top view of the inventory control probe.

Turning to FIGS. 6, 7 and 8, data is written and read from the touch memory cannister 200 of the inventory control collar 100 with an inventory control probe 300 by concurrently touching the probe tip 310, having contact pins 312 and 314 to the conductive rings 150 and 160 exposed on the upper surface of the inventory control collar 100. Data is transmitted by means of the metal-to-metal contact between the conductive rings 150 and 160, attached to the touch memory cannister 200, and the contact pins 312 and 314.

Although preferred and alternative embodiments of the invention have been illustrated in the accompanying Drawings and described in the foregoing Detailed Description, it will be understood that the invention is not limited to the embodiments disclosed but are capable of numerous modifications without departing from the scope of the invention as claimed.

We claim:

1. A locking ring for securing an inventory control collar on a storage container, said storage container having a neck of predetermined size and shape, said inventory control collar sized to fit around said neck of said storage container and containing a radially inwardly projecting holding surface for receiving said locking ring, said locking ring comprising:

a circular disc having an external perimeter sized to be received on the holding surface of said inventory control collar, said circular disc having a surface for mating with the holding surface and a central opening sized to fit around the neck of said storage container; and a plurality of radially inwardly disposed flexible tabs formed integral with the central opening of said disc and extending radially inward from the central opening, said tabs spaced around the perimeter of the central opening and having a length of projection sufficient to engage the neck of said storage container, each tab having an upper surface angularly disposed upward from a plane of the disc at a first angle, and an under surface angularly disposed upward from the plane of the disc at a second angle greater than the first angle of the upper surface.

2. The inventory control collar locking ring of claim 1 wherein the angular displacement of said under surface from the plane of the disc equals approximately 25 degrees.

3. A locking ring for securing an inventory control collar on a storage container, said storage container having a neck of predetermined size and shape, said inventory control collar sized to fit around said neck of said storage container and containing a radially inwardly projecting holding surface for receiving said locking ring, said locking ring comprising:

a circular disc of polymeric material and having an external perimeter sized to be received on the holding surface of said inventory control collar, said circular disc having a surface for mating with the holding surface and a central opening sized to fit around the neck of said storage container; and a plurality of radially inwardly projecting flexible tabs formed integral with the central opening of said disc, said tabs extending radially inward from the central opening, and equally spaced around the perimeter of the central opening and having a length of projection sufficient to engage the neck of said storage container, each of said tabs having an upper surface angularly disposed upward from a plane of the disc at a first angle, and an under surface angularly disposed upward from the plane of the disc at a second angle greater than the first angle of the upper surface.

4. The inventory control collar locking ring of claim 3 wherein the angular displacement of said under surface from the plane of the disc equals approximately 25 degrees.

5. A locking ring for securing an inventory control collar on a storage container, said storage container having a neck of predetermined size and shape, said inventory control collar having a central opening sized to fit around said neck of said storage container and including an inwardly projecting ledge for receiving a locking ring, said ledge positioned within the central opening and attached at a circumference to the perimeter of the central opening, said locking ring comprising:

a circular disc of a polymeric material and having an external perimeter sized to be received on the inwardly projecting ledge of said inventory control collar, said circular disc having a surface for mating with the holding surface and a central opening sized to fit around the neck of said storage container; and a plurality of radially inwardly projecting flexible tabs of polymeric material integral with said disc, said tabs extending radially inward from the central opening, and equally spaced around the perimeter of the central opening and having a length of projection sufficient to engage the neck of said storage container, each of said tabs having an upper surface angularly disposed upward from a plane of the disc at a first angle, and an under surface angularly disposed upward from the plane of the disc at a second angle greater than the first angle of the upper surface.

6. The inventory control collar locking ring of claim 5 wherein the angular displacement of said under surface from the plane of the disc equals approximately 25 degrees.

* * * * *